United States Patent [19]

Lipschutz

[11] 4,194,957

[45] Mar. 25, 1980

[54] APPARATUS FOR THE ELECTROLYTIC TREATMENT OF METALLIC PARTS

[75] Inventor: Paul Lipschutz, Croissy, France

[73] Assignee: Neiman S.A., Courbevoie, France

[21] Appl. No.: 923,529

[22] Filed: Jul. 11, 1978

[30] Foreign Application Priority Data

Jul. 20, 1977 [FR] France ..... 77 22333

[51] Int. Cl.[2] ..... C25D 17/06; C25D 17/22

[52] U.S. Cl. ..... 204/199; 204/212

[58] Field of Search ..... 204/297 W, 212, 199, 204/200, 201

[56] References Cited

U.S. PATENT DOCUMENTS

| | | | |
|---|---|---|---|
| 1,970,458 | 8/1934 | Kelly | 204/297 W |
| 2,228,672 | 1/1941 | Olson | 204/199 |
| 2,749,300 | 6/1956 | Thomas | 204/200 |

*Primary Examiner*—T. M. Tufariello

*Attorney, Agent, or Firm*—James Creighton Wray

[57] ABSTRACT

The invention relates to the electrolytic treatment of metallic parts, and more especially, the obtaining of electrical contact between the parts which have to be treated and an electrode of the electrolytic bath.

9 Claims, 11 Drawing Figures

APPARATUS FOR THE ELECTROLYTIC TREATMENT OF METALLIC PARTS

In a known process using a drum the main disadvantages are insufficient thickness of the deposited layer and limitation as to materials used. The so-called "dead-bath" process is complicated and necessitates manual fixing of each part to be treated.

The present invention overcomes these disadvantages and comprises a process in which the said parts are arranged in a tank in electrical contact with an electrode, in which the parts to be treated are arranged so as to be radially movable on a support and the said support is subjected to rotation at sufficient speed to obtain by centrifugal force the radial displacement of the parts to be treated and the application of them to a contact with is connected electrically to the said electrode. The parts are carried by a tank support which rotates conjointly and is electrically connected to the said electrode, and the said tank rotates.

The invention relates to the electrolytic treatment of metallic parts, and more especially, the obtaining of electrical contact between the parts which have to be treated and an electrode of the electrolytic bath.

An electrolytic treatment process using drums is known. This known process only produces depositions of very slight thickness and is, moreover, limited to certain materials. It does not produce a very good electrical contact between the electrode and the part which has to be treated, so that certain treatments, for example, chromium plating, cannot be carried out in drums.

A so-called "dead bath" electrolytic treatment process, which permits practically all the desired qualities and thicknesses to be obtained, is also known. However, this known process can only be put into practice in a complicated and very cumbersome manner. It requires, moreover, considerable manpower, owing to the fact that the parts which are to be treated must be fixed one by one manually on the metallic frame which acts as an electrode and must then be dismantled in the same way at the end of the treatment.

This process moreover necessitates the use of a considerable number of tanks in which the part-holding frames are immersed in succession, in order to undergo a specific treatment therein. Furthermore, in order that the electrical contact between the parts which are to be treated and their frame-support can be perfect whilst producing perfect insulation of the frame itself, it is necessary to ensure maintenance of these frames, which is complicated and cumbersome.

The object of the present invention is to remove these disadvantages of the known processes.

To this end, the subject of the invention is an electrolytic treatment process for metallic parts in which the said parts are arranged in a tank in electrical contact with an electrode, in which the parts to be treated are arranged so as to be radially movable on a support and the said support is subjected to rotation at sufficient speed to obtain by centrifugal force the radial displacement of the parts to be treated and the application of them to a contact which is connected electrically to the said electrode, a process which is characterized by the fact that the parts are carried by a tank support which rotates conjointly and is electrically connected to the said electrode, and the said tank rotates.

The subject-matter of the invention is also a device for putting this process into practice.

The invention will be duly understood by reading the following description made with reference to the attached drawing, in which.

Figure 1:
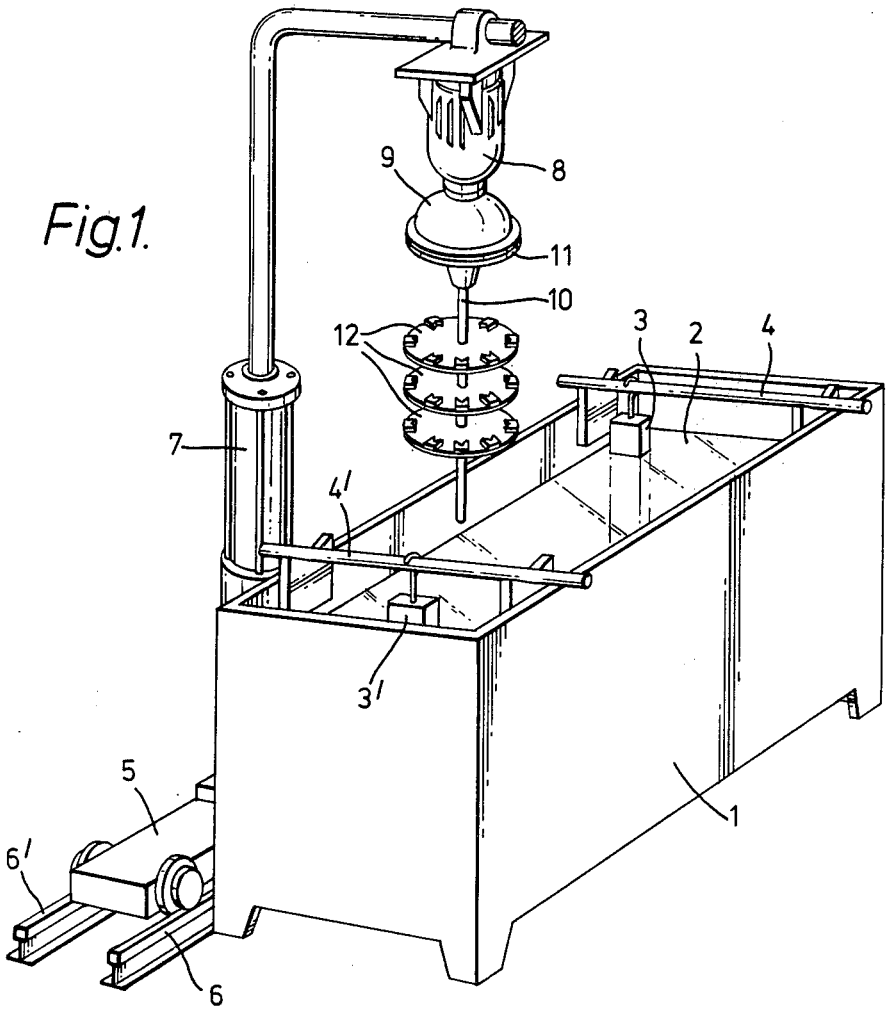
FIG. 1 is a diagrammatic perspective view of a rotary part-carrying device and device with a fixed tank in accordance with one exemplified embodiment of the invention.

Reference is first of all made to FIGS. 1 to 8.

The device comprises a tank filled with electrolyte comprising anodes 3 and 3' connected by bars 4 and 4' to one of the poles of a current source (not represented), the other pole being connected to a part support. An automatic (robot) assembly 5 moving on rails 6 and 6' is provided with a pneumatic or hydraulic jack 7 allowing the linear displacement and the ascent or descent of an assembly comprising the fitting furnished with the parts and its rotational system.

This assembly consists of an electric motor 8 coupled to an electromagnet 9 or to any other means of attachment. An axis 10 of conductive material, which is connected to the current source through a collector, carries on its upper part a pure iron plate 11. This axis carries plates 12, which are provided on the one hand with cavities 13, 13' and 13'' etc., and on the other hand, with contacts 14, 14' and 14'' etc., which are electrically connected to the conductor axis 10.

The parts which are to be treated 15, 15' etc. are located in the cavities 13, 13' etc., respectively.

Figure 2:
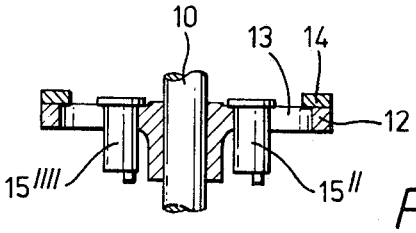
FIG. 2 is a view in axial section of a part-carrying plate forming part of the device of FIG. 1, in course of charging with the parts to be treated.
Figure 3:
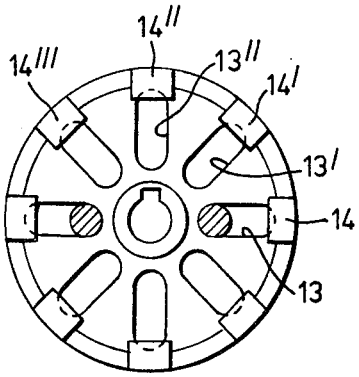
FIG. 3 is a plan view of the plate of FIG. 2.
Figure 4:
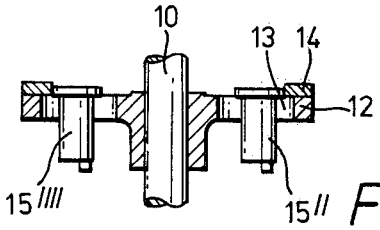
FIG. 4 is similar to FIG. 2, the plate rotating.
Figure 5:
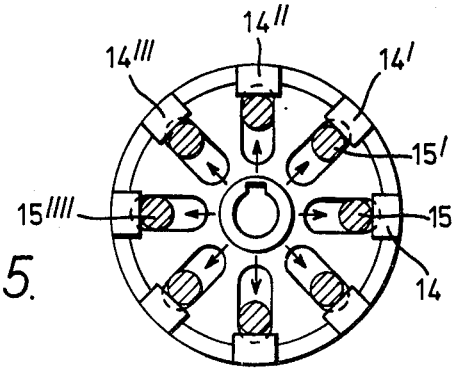
FIG. 5 is similar to FIG. 3, but for the position of FIG. 4.
Figure 6:
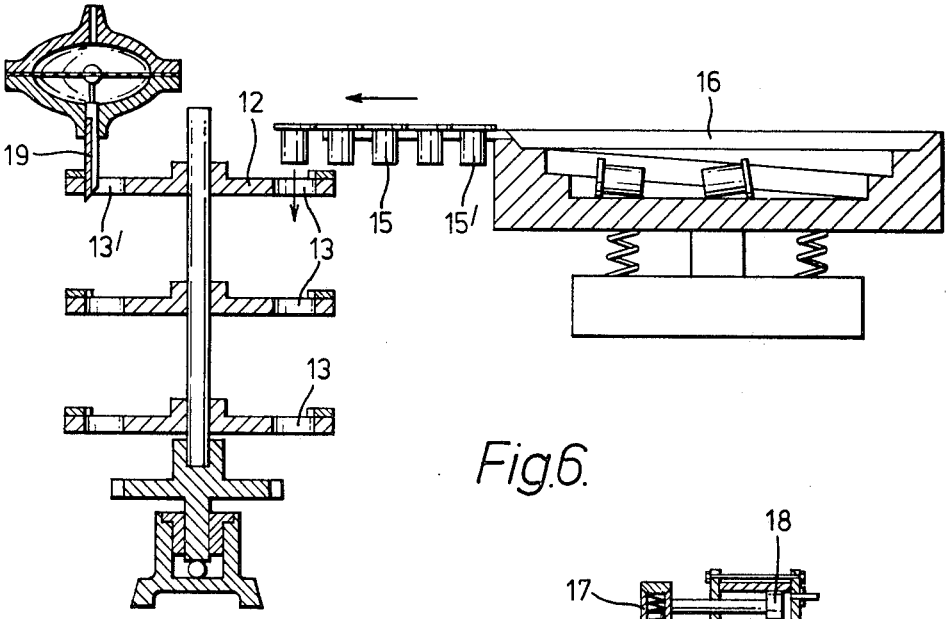
FIG. 6 is a diagrammatic view of a charging device used with the device of FIGS. 1 to 5.
Figure 7:
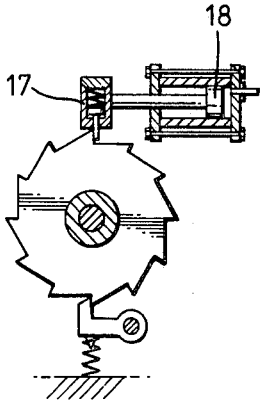
FIG. 7 is a diagrammatic view of a device for driving the plates of the device of FIGS. 1 to 6.

The device operates in the following manner:

The charging of the parts to be treated in the plates is carried out automatically by means of a vibrator (see FIG. 6). The parts fall into the cavities 13, 13' etc. (FIGS. 2 and 3). Once the plate is charged, the robot 5 seizes them with the aid of the electromagnet 9 and leads them towards the electrolysis tank 1. The charged plates are immersed in the bath by the jack 7, after which the plates are gradually made to rotate by the motor 8. As soon as a definite speed is reached, centrifugal force projects the parts outwardly and they are strongly applied to the contacts 14, 14', 14'' etc. (see FIGS. 4 and 5).

FIG. 6 illustrates the filling of the plates with parts deposited in bulk in a vibrator 16. The parts 15, 15' etc. are presented by the vibrator facing the cavities 13, 13' etc., and the plates 12 advance gradually with the aid of a ratchet 17 and jack 18 system (FIG. 7), so that with each angular displacement of the plate, one part falls into a cavity.

In a parallel direction a pneumatic, hydraulic or mechanical tool 19 ensures the cleaning of the contacts 14, 14' etc. Of course, the vibrator 16 possesses as many outputs as there are plates 12.

Figure 8:
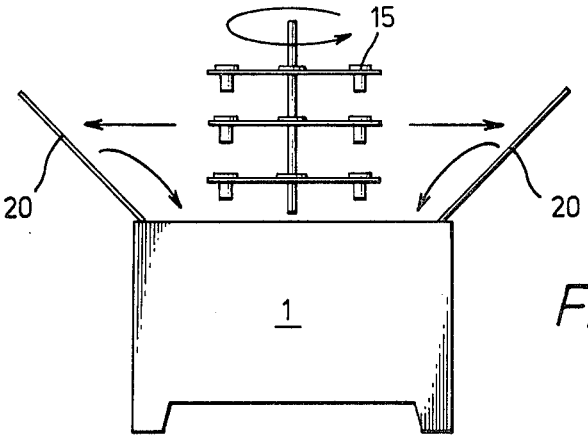
FIG. 8 is a diagrammatic view in elevation of the device of FIG. 1 in use for drying.

FIG. 8 illustrates the use of the device for drying the parts. The part-carrying assembly is raised on the outside of the tank 1 and set rotating in order to ensure drying. Guards 20 receive the liquid in the course of drying, and the latter falls again into the tank in accordance with the arrows.

The installation naturally comprises several tanks such as the tank 1, each one containing a different liquid and producing a special function and served by the robot assembly 5 which moves on the rails 6 and 6'. The drying which is carried out at the output of each tank avoids waste from the baths being contained in the various tanks and also contamination of them by the preceding bath. Drying also permits the drying operations which are usually necessary to be avoided.

As has been seen, the charging of the parts which are to be treated is carried out automatically before the first tank, by means of the vibrator 16.

Furthermore, the rotation of the parts and the plates in the various baths ensures permanent homogenization of the bath, without its being necessary to provide any special agitating operation.

Figure 9:
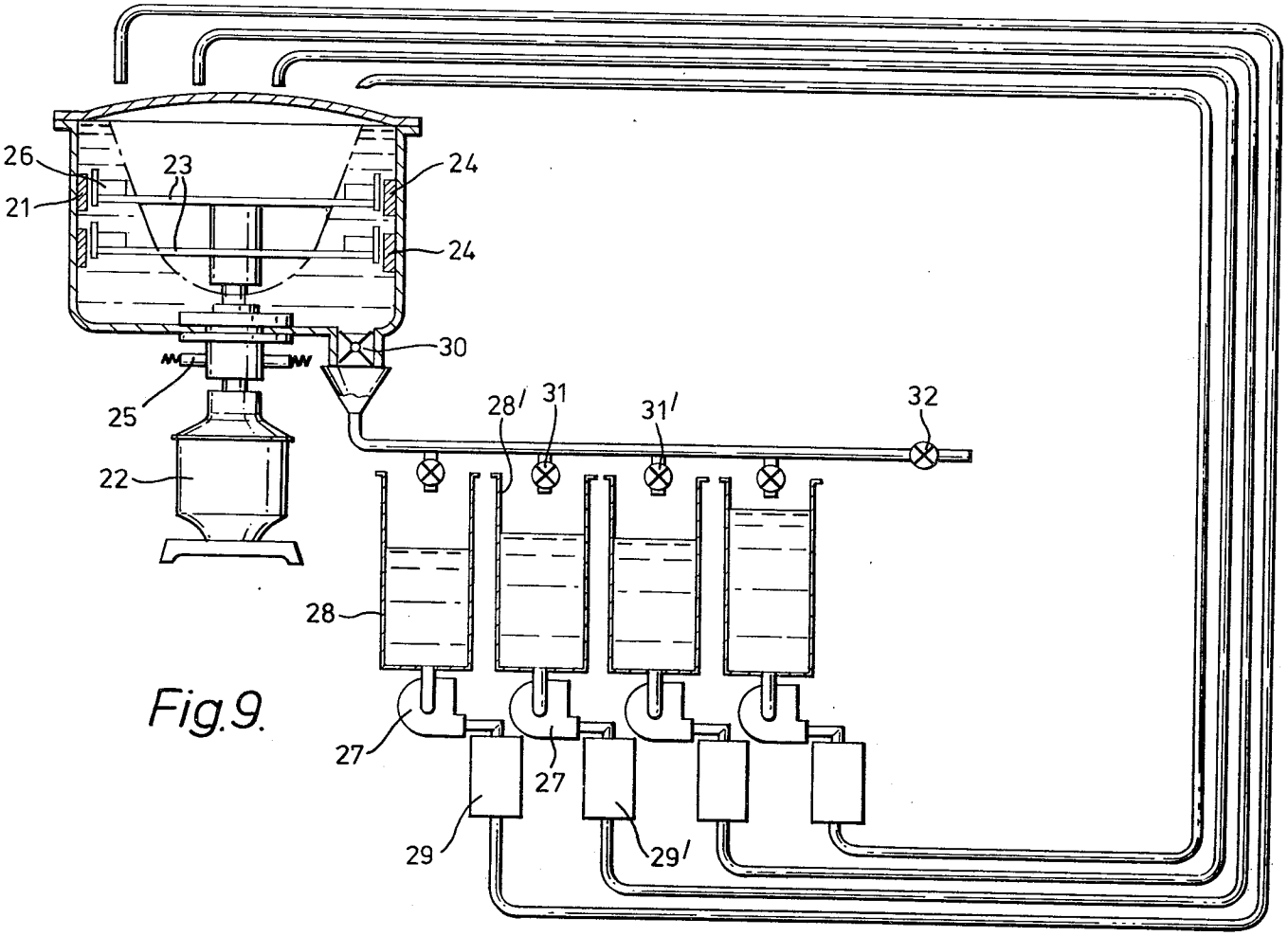
FIG. 9 is a diagrammatic view of one variant of the device in accordance with the invention comprising a rotating tank.
Figure 10:
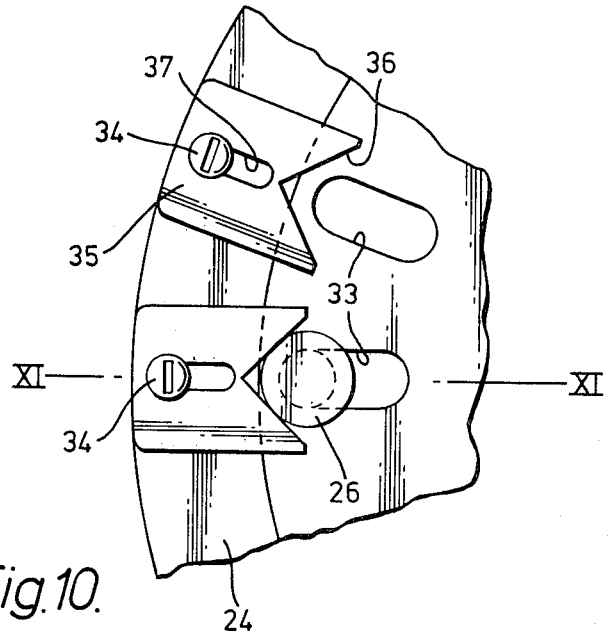
FIG. 10 is a plan view of one part of a part support forming a member of the device of FIG. 9.
Figure 11:
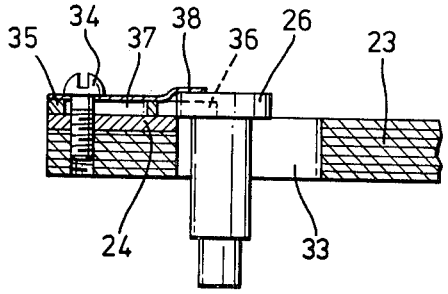
FIG. 11 is a view in longitudinal section along the line XI—XI of FIG. 10.

Reference is now made to FIGS. 9 to 11, which describe one variation of realization of a device in accordance with the invention using a single rotary tank.

The installation comprises a rotating tank 21 driven by a motor 22 and provided with plates 23, which are immovable but rotate with the tank. The plates 23, which are of insulating material, comprise at their peripheral extremities a conductive ring 24, which is electrically connected to a current collector 25 in such a way as to constitute one of the electrolysis electrodes. The plates 23 carry the parts which are to be treated, by means of a fitting which will be described later and which ensures the placing of these parts in electrical contact with the conductive ring 24 in the course of rotation of the tank 21.

A liquid is introduced into the tank 21 by means of a pump 27, 27' etc. serving a tank 28, 28' etc. respectively, which contains a liquid which is intended for a special operation, for example, scouring, electrolysis etc., by the intermediary of a respective filter 29, 29' etc. Rotating of the tank 21 by the motor 22 causes the free surface of the liquid to take on a revolving paraboloid shape, the parts 26 being arranged in such a way as to be bathed by the liquid in the course of rotation.

The tank 21 comprises an electric outlet sluice 30 which after each operation, brings the liquid which the tank 21 contains back into the tank 28, 28' etc., which can be arranged by the intermediary of a corresponding electric sluice 31, 31' etc.

An electric sluice 32 permits complete drainage without recycling to be carried out when the liquid has to be replaced by new liquid.

The structure of the plates 23 and the conductive ring 24 has been represented in more detail in FIGS. 10 and 11. The plates 23 comprise, regularly arranged angularly in the vicinity of their periphery, stud-holes 33 lengthened radially, in each of which is located a part 26 which is to be treated. The conductive ring 24 is fixed to the edge of the plate 23 in such a way as to be flush with the outside extremity of the stud-holes 33.

Facing each stud-hole 33 and in the peripheral zone of the plate 23 there is mounted by means of a screw 34, a conductive part 35 comprising a V shaped indentation turned towards the stud-hole 33. The hole 37 for the passage of the screw 34 into the part 35 is lengthened in order to permit control of the positioning of the indentation 36 in relation to the stud-hole 33 in order to adapt it to the part which has to be treated. A stop 38, which is similarly fixed by the screw 34, prevents the part which has to be treated, 26, from rising when it is supported against the indentation 36.

The plates 23 are preliminarily charged automatically with parts 26 by means of suitable distributors and are then put in place in the tank 21, which is preliminarily partially filled with the first liquid from the operational range which is in the tank 29 (for example, scouring liquid).

Starting of the motor 22 causes the tank 21 to rotate, and with it, the plates 23 and the parts carried by these plates. Centrifugal force projects the parts 26 outwardly, and the latter come into abutment against the indentation 36 of the conductive part 35, thus ensuring perfect electrical contact with the part 35, which itself is connected to the ring 24 and therefore to the collector 25. If operation is to be carried out by passing current into the liquid 27, the electrical contact between the parts 26 which are to be treated and the electrode will thus be fully guaranteed.

At the end of the operation, the liquid is drained by the electric sluice 30 and brought back to the tank 28 by the electric sluice 31. The tank 21 is then partially drained of the second liquid from the operational range originating from the tank 29', and the process which has just been described recommences. This cycle is performed as many times as there are tanks such as 29, 29' etc. The treatment assembly can, of course, be driven automatically by a servo system acting on the motor 22 and the various electric sluices.

I claim:

1. Apparatus for the electrolytic treatment of metallic parts comprising:

(a) an electrolytic treatment tank, (b) an electrode which is connected to one pole of an electrical sourse, (c) an axially rotatable insulating plate to support the parts to be treated in the tank, the plate having elongated radial stud holes which are regularly spaced in the vicinity of its periphery and means at its periphery connected to the electrode, (d) means for feeding in turn each part to a radial stud hole, and (e) means for rotating the plate about its axis at a speed which is sufficient to produce by centrifugal force a radial displacement of the parts towards the periphery of the plate to contact the peripheral electrode connection means.

2. Apparatus according to claim 1, in which the connection means comprises contacts provided at the outside extremity of each stud hole.

3. Apparatus according to claim 2, in which the said contacts are mounted on a conductive ring which is an integral part of the said plate and is connected to the said electrode.

4. Apparatus according to claim 2 in which the said contacts project into the stud holes.

5. Apparatus according to claim 2, in which the said contacts comprise an indentation whose concavity is turned towards the centre of the said plate.

6. Apparatus according to claim 2, in which the radial position of the said contacts can be adjusted.

7. Apparatus according to claim 1, in which the outside extremity of each stud hole comprises a stop under which the part which is to be treated is placed when it is applied to the said contact.

8. Apparatus according to claim 3, in which foldable guards are provided at an incline round the top edges of the said tank.

9. Apparatus according to claim 1 in which a device for automatic cleaning of the said contacts is provided.

* * * * *